US011371503B2

(12) United States Patent
Costa De Oliveira

(10) Patent No.: US 11,371,503 B2
(45) Date of Patent: Jun. 28, 2022

(54) SMART DRILLING MOTOR STATOR

(71) Applicant: Saudi Arabian Oil Company, Dhahran (SA)

(72) Inventor: Victor Carlos Costa De Oliveira, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 184 days.

(21) Appl. No.: 16/716,362

(22) Filed: Dec. 16, 2019

(65) Prior Publication Data

US 2021/0180592 A1 Jun. 17, 2021

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 2/107*** | (2006.01) |
| ***E21B 4/02*** | (2006.01) |
| *F04C 13/00* | (2006.01) |

(52) U.S. Cl.

CPC ..... *F04C 2/1075* (2013.01); *E21B 4/02* (2013.01); *F04C 13/008* (2013.01); *F04C 2230/60* (2013.01); *F04C 2240/81* (2013.01); *F04C 2270/86* (2013.01); *F05C 2225/02* (2013.01)

(58) Field of Classification Search

CPC .... F04C 2/1071; F04C 2/1075; F04C 13/008; F04C 14/28; F04C 2230/60; F04C 2240/10; F04C 2240/81; F04C 2270/86; F04C 2270/90; F05C 2225/02; F05C 2251/02; E21B 7/068; E21B 4/02

See application file for complete search history.

(56) References Cited

U.S. PATENT DOCUMENTS

| | | | | |
|---|---|---|---|---|
| 3,771,906 A | | 11/1973 | Bourke | |
| 5,171,138 A | | 12/1992 | Forrest | |
| 5,298,211 A | * | 3/1994 | Hamanaka ..... | C08L 91/00 264/211.24 |

(Continued)

FOREIGN PATENT DOCUMENTS

| | | |
|---|---|---|
| EP | 1739307 A2 | 1/2007 |
| WO | 2018212759 A1 | 11/2018 |

OTHER PUBLICATIONS

International Search Report and Written Opinion of PCT Application No. PCT/US2020/065211 dated Mar. 16, 2021: pp. 1-12.

*Primary Examiner* — Theresa Trieu

(74) *Attorney, Agent, or Firm* — Bracewell LLP; Constance G. Rhebergen; Linda L. Morgan

(57) ABSTRACT

A drilling motor system for drilling a subterranean well includes a stator tube, the stator tube being an elongated tubular member with a central stator bore. A stator elastomer layer is located within the central stator bore, lining a wall of the central stator bore. The stator elastomer layer has an elastomer bore that includes a plurality of stator lobes extending in a helical pattern along an axial length of the central bore. A rotor is located within the elastomer bore, the rotor being an elongated member that includes a plurality of rotor lobes extending in a helical pattern along an axial length of the rotor. The stator elastomer layer includes a failure detection system, the failure detection system operable to identify a region of damaged stator elastomer layer.

12 Claims, 3 Drawing Sheets

(56) References Cited

U.S. PATENT DOCUMENTS

| | | | | |
|---|---|---|---|---|
| 5,385,407 | A * | 1/1995 | De Lucia | E21B 4/003 175/107 |
| 5,905,319 | A | 5/1999 | McLendon | |
| 6,241,494 | B1 | 6/2001 | Pafitis et al. | |
| 6,881,045 | B2 | 4/2005 | Zitka et al. | |
| 6,905,319 | B2 | 6/2005 | Guo | |
| 7,192,260 | B2 | 3/2007 | Lievestro et al. | |
| 7,442,019 | B2 | 10/2008 | Kaiser et al. | |
| 8,899,351 | B2 * | 12/2014 | Hay | F04C 2/1071 418/48 |
| 9,803,636 | B2 | 10/2017 | Rothschild et al. | |
| 9,896,885 | B2 | 2/2018 | Blake et al. | |
| 10,139,326 | B2 | 11/2018 | Ba et al. | |
| 2008/0050259 | A1 | 2/2008 | Hooper | |
| 2009/0169364 | A1 | 7/2009 | Downton | |
| 2015/0292280 | A1 * | 10/2015 | Lewis | E21B 4/02 175/25 |
| 2016/0195087 | A1 * | 7/2016 | Downton | F04C 2/1075 418/48 |
| 2016/0201667 | A1 | 7/2016 | Tonami et al. | |
| 2017/0152741 | A1 | 5/2017 | Park et al. | |
| 2018/0320445 | A1 | 11/2018 | Akbari et al. | |

* cited by examiner

SMART DRILLING MOTOR STATOR

BACKGROUND OF THE DISCLOSURE

1. Field of the Disclosure

The present disclosure relates to subterranean well development, and more specifically, the disclosure relates to drilling motors used for drilling subterranean wells.

2. Description of the Related Art

A drilling motor can be used while drilling a subterranean well. A drilling motor is a progressive cavity positive displacement pump (PCPD) placed in the drill string to provide additional power to the bit while drilling. The drilling motor converts the hydraulic energy of drilling fluid into eccentric motion which is transferred as concentric power to the drill bit. A drilling motor can have a rotor and stator configuration selected to provide optimum performance for the desired drilling operation. The stator and rotor lobe ratio, the number of stages, and the external diameter can be adjusted to achieve the optimum torque and rotational speed of the drilling motor.

The helical rotor will rotate eccentrically when the stator contains more lobes than the rotor. The flow of the fluid transmits power allowing the assembly to rotate and turn the bit. The drilling motor stator can be lined with an elastomer. A failure of the drilling motor can be due to a failure of this elastomer stator elastomer.

The use a drilling motor can be determined by financial efficiency. In straight vertical wellbores the mud motor may be used solely for increased rate of penetration or to minimize erosion and wear on the drill string, since the drill string does not need to be turned as fast. A drilling motor can improve the penetration rate since the rotation speeds are high which it is a good option while drilling hard formations.

Drilling motors are more commonly used in the drilling of directional wellbores. Although other methods may be used to steer the bit to the desired target zone, such other methods can be more time consuming which adds to the cost of the well. Drilling motors can be configured to have a bend using different settings on the motor itself. Typical drilling motors can be modified with a bend from zero degrees to three degrees. The amount of bend is determined by buildup rate needed to reach the target zone. By using a measurement while drilling tool, a directional driller can steer the bit to the desired target zone.

SUMMARY OF THE DISCLOSURE

Sometimes while drilling, piece of rubbers can be found in the shale shakers. The similarity of the drilling motor stator's elastomer with another elastomer used in the drilling equipment such as rubber from a Kelly hose can result in an incorrect diagnoses of equipment failure. An early identification of a failure of the drilling motor stator's elastomer can prevent or reduce damage to the other parts of the drilling motor and prevent or reduce the risk of complete failure of the drilling motor.

Embodiments of the current application provide systems and method for early identification of a failure of the stator elastomer. A dyed stator elastomer can assist drilling engineers, foreman, and directional drillers in correctly identifying a failure of the stator elastomer by identifying that a rubber found in the shaker is from the drilling motor stator. A color code or multiple color system can further pinpoint the location of the failure of the stator elastomer within the drilling motor. Knowing the location of the stator elastomer failure can assist in identifying the cause of the failure of the stator elastomer.

Systems and method of the disclosure can include multiple sensors located within the stator elastomer layer along the length of the stator. The sensors can be monitored individually through a communication system. If a sensor fails, it can be an indication of a stator elastomer failure at the location of such sensor. After identifying a failed sensor, the shakers can be examined to identify any piece of rubber from the drilling motor that has been separated from the stator.

In an embodiment of this disclosure, a drilling motor system for drilling a subterranean well includes a stator tube. The stator tube is an elongated tubular member with a central stator bore. A stator elastomer layer is located within the central stator bore, lining a wall of the central stator bore. The stator elastomer layer has an elastomer bore that includes a plurality of stator lobes extending in a helical pattern along an axial length of the central bore. A rotor is located within the elastomer bore. The rotor is an elongated member that includes a plurality of rotor lobes extending in a helical pattern along an axial length of the rotor. The stator elastomer layer includes a failure detection system. The failure detection system is operable to identify a region of damaged stator elastomer layer.

In alternate embodiments, the failure detection system can include a dyed elastomer material that forms the stator elastomer layer. The dyed elastomer material can be operable to identify the region of damaged stator elastomer layer. The dyed elastomer material can include two or more color codes, each color code being located along a separate portion of the axial length of the stator elastomer layer.

In other alternate embodiments, the failure detection system can include a plurality of sensors. The plurality of sensors can be spaced axially within the stator elastomer layer. The failure detection system can include a communication system with a central unit that is operable to transmit a status of each of the plurality of sensors. The communication system can be operable to activate the central unit to deliver the status of each of the plurality of sensors. The communication system can include a timer operable to activate and deactivate the central unit.

In another embodiment of this disclosure, a drilling motor system for drilling a subterranean well includes a stator tube. The stator tube is an elongated tubular member with a central stator bore. A top sub is secured to an uphole end of the stator tube. The top sub has a connection member operable to connect the top sub to a drilling string. A stator elastomer layer is located within the central stator bore and lines a wall of the central stator bore. The stator elastomer layer has an elastomer bore that includes a plurality of stator lobes extending in a helical pattern along an axial length of the central stator bore. The stator elastomer layer includes a failure detection system. The failure detection system is operable to identify a region of damaged stator elastomer layer. A rotor is located within the elastomer bore. The rotor is an elongated member that includes a plurality of rotor lobes extending in a helical pattern along an axial length of the rotor. A transmission assembly is rotationally secured between the rotor and a drill bit drive shaft. A bottom sub is secured downhole of the stator tube, the bottom sub housing the drill bit drive shaft and a bearing assembly.

In alternate embodiments, the failure detection system can include a dyed elastomer material that forms the stator elastomer layer. The dyed elastomer material can be operable to identify the region of damaged stator elastomer layer. The failure detection system can include a plurality of sensors, the plurality of sensors spaced axially within the stator elastomer layer. The failure detection system can include a dyed elastomer material that forms the stator elastomer layer. The dyed elastomer material can be operable to identify the region of damaged stator elastomer layer. The failure detection system can further include a plurality of sensors, the plurality of sensors spaced axially within the stator elastomer layer.

In yet another alternate a method for drilling a subterranean well with a drilling motor system includes providing the drilling motor system having a stator tube, the stator tube being an elongated tubular member with a central stator bore. A stator elastomer layer is located within the central stator bore and lines a wall of the central stator bore. The stator elastomer layer has an elastomer bore that includes a plurality of stator lobes extending in a helical pattern along an axial length of the central stator bore. The stator elastomer layer includes a failure detection system. A rotor is located within the elastomer bore, the rotor being an elongated member that includes a plurality of rotor lobes extending in a helical pattern along an axial length of the rotor. The method includes identifying a region of damaged stator elastomer layer with the failure detection system.

In alternate embodiments, identifying the region of damaged stator elastomer layer with the failure detection system can include identifying the region of damaged stator elastomer layer with a dyed elastomer material that forms the stator elastomer layer. The dyed elastomer material can include two or more color codes, each color code being located along a separate portion of the axial length of the stator elastomer layer.

In other alternate embodiments, identifying the region of damaged stator elastomer layer with the failure detection system can include identifying the region of damaged stator elastomer layer with a plurality of sensors, the plurality of sensors spaced axially within the stator elastomer layer. The method can alternately include transmitting a status of each of the plurality of sensors with a communication system with a central unit. The central unit can be activated with the communication system to deliver the status of each of the plurality of sensors. The method can alternately further include activating and deactivating the central unit with a timer of the communication system.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
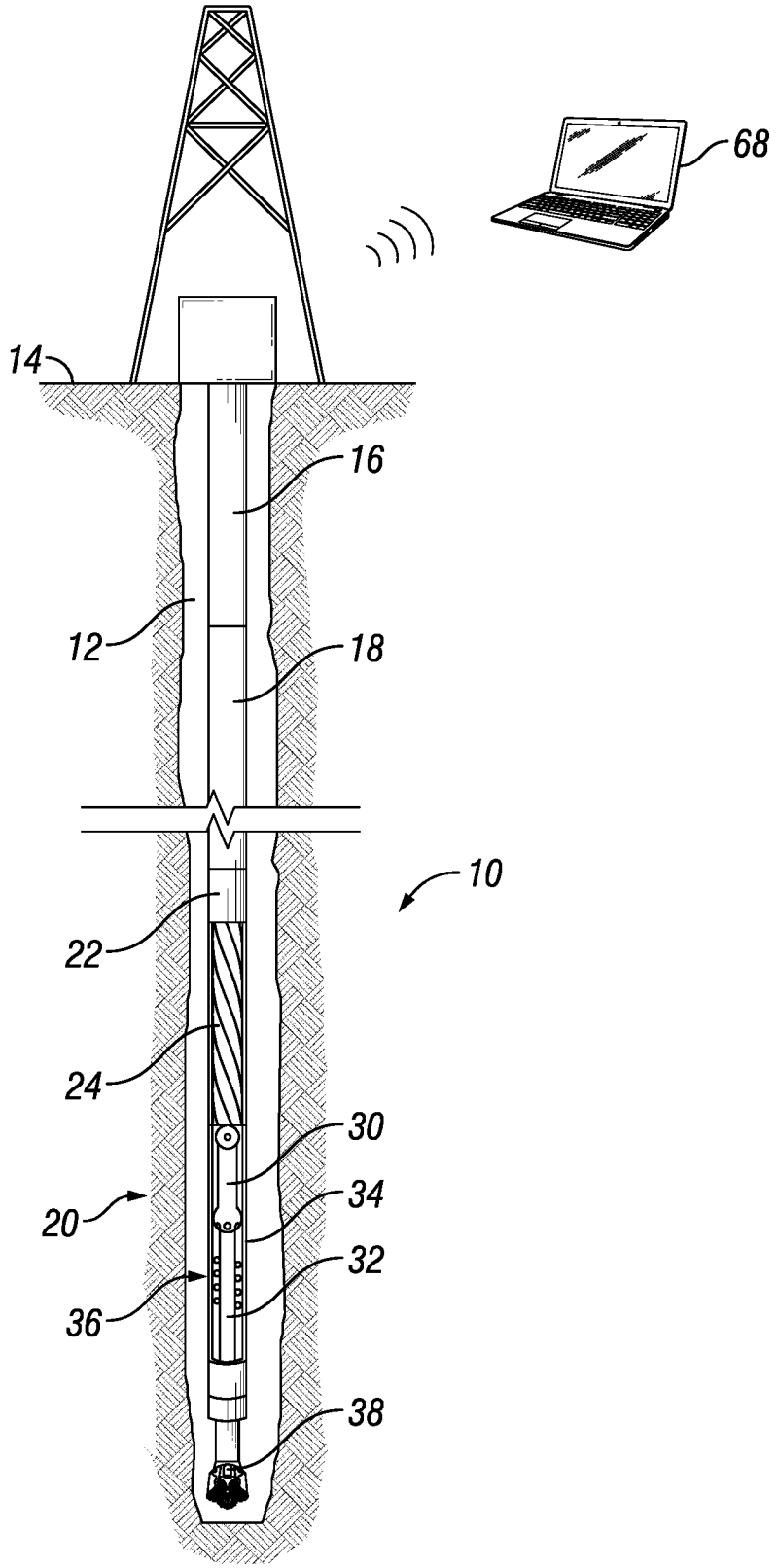
FIG. 1 is a partial section view of a subterranean well with a drilling motor system, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Drill string 16 can be delivered into and located within wellbore 12. Drill string 16 can include tubular member 18 and drilling motor system 20. Tubular member 18 can extend from surface 14 into subterranean well 10.

Drill string 16 can be used to drill wellbore 12. Wellbore 12 can be drilled from surface 14 and into and through various formation zones of subterranean formations. Drilling motor system 20 can be used to assist in drilling wellbore 12. Drilling motor system 20 can include top sub 22. Top sub 22 has a connection member that secures drilling motor system 20 to tubular member 18 of drill string 16. In certain embodiments, top sub 22 can include a float bore if a float valve is desired, or can include an internal bypass valve so that drill string 16 can drain when drill string 16 is being pulled out of wellbore 12.

Figure 2:
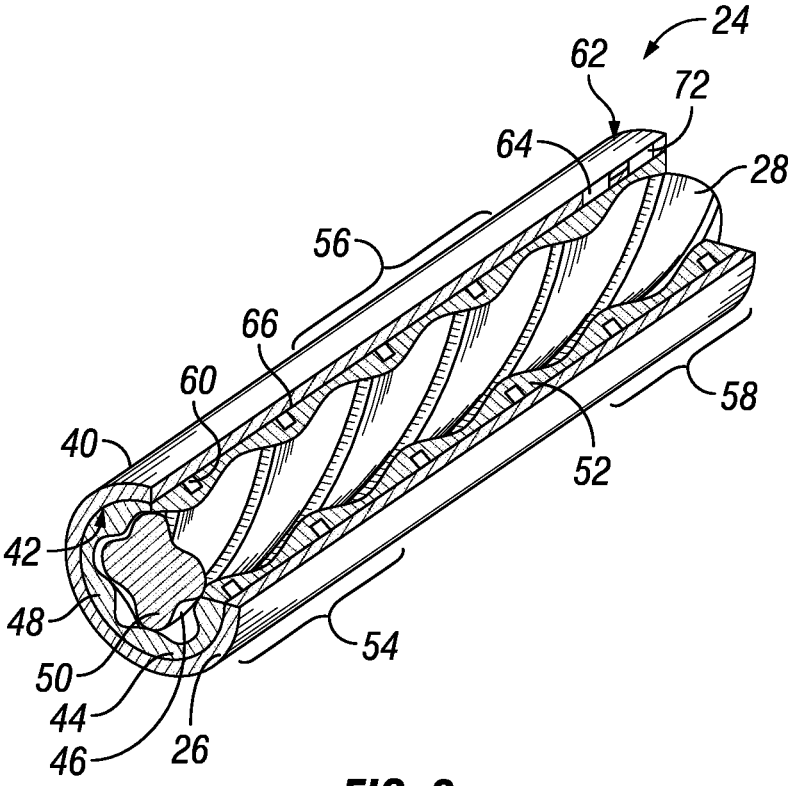
FIG. 2 is a partial elevation section view of a power section of a drilling motor system, in accordance with an embodiment of this disclosure.

Top sub 22 is secured to power section 24. Power section 24 includes stator assembly 26 and rotor 28 (FIG. 2). Transmission assembly 30 is rotationally secured between the rotor 28 and drill bit drive shaft 32. Transmission assembly 30 coverts eccentric motion of rotor 28 to concentric rotation for transmission to drill bit drive shaft 32. Transmission assembly 30 can include, for example, two universal joints or a constant-velocity joint.

Bottom sub 34 houses drill bit drive shaft 32 and bearing assembly 36. Bottom sub 34 is secured downhole of stator assembly 26. Bearing assembly 36 protects drilling motor system 20 from off bottom and on bottom pressures. Drill bit drive shaft 32 transmits rotation to drill bit 38 for drilling wellbore 12.

Looking at FIG. 2, power section 24 includes stator tube 40. Stator tube 40 is an elongated tubular member with central stator bore 42. Stator elastomer layer 44 is located within central stator bore 42. Stator elastomer layer 44 lines an inner wall of central stator bore 42.

Elastomers used to form stator elastomer layer 44 can be characterized by the ability of the elastomer to be temporarily deformed, often under a great degree of tensile stress, and return to its original state with little or no permanent degradation. Stator elastomer layer 44 can be formed of, for example, a nitrile or acrylonitrile butadiene rubber.

Figure 3:
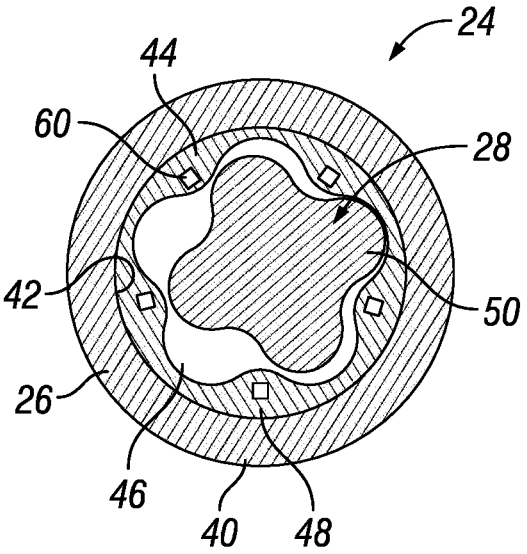
FIG. 3 is a cross section view of a power section of a drilling motor system, in accordance with an embodiment of this disclosure.

Stator elastomer layer 44 extends the axial length of central stator bore 42. Stator elastomer layer 44 includes elastomer bore 46 that includes a plurality of stator lobes a plurality of stator lobes 48. Stator lobes 48 extend in a helical pattern along the axial length of central stator bore 42. Stator elastomer layer 44 of FIGS. 2-3 are shown as forming the pattern of stator lobes 48 by varying the thickness of stator elastomer layer 44 around the inner diameter of central stator bore 42. In alternate embodiments the general shape of stator lobes 48 can be formed by stator tube 40 or by an intermediate layer between stator tube 40 and stator elastomer layer 44. In such an embodiment, stator elastomer layer 44 will have a thin even thickness.

Rotor 28 is located within elastomer bore 46. Rotor 28 is an elongated member that includes a plurality of rotor lobes 50 on an outer diameter surface of rotor 28. Rotor lobes 50 extend in a helical pattern along an axial length of rotor 28.

Power section 24 can be sized for a particular subterranean well 10. A drilling motor is described in terms of the number of stages, the lobe ratio and the external diameter. Stages are the number of full twists that stator lobes 48 make from one end of central stator bore 42 to the opposite end of central stator bore 42. The lobe ratio is the number of stator lobes 48 to the number of rotor lobes 50. There will always be one more stator lobes 48 than rotor lobes 50. A higher number of stages indicates a more powerful motor. A higher number of lobes indicates a higher torque output for a given differential pressure. A lower number of lobes indicates a reduction in the torque produced but a faster rotation speed of drill bit 38.

There may be times when operating conditions and environmental factors degrade stator elastomer layer 44 or induce mechanical failure of stator elastomer layer 44. Stator elastomer layer 44 can fail in a variety of ways. As an example, stator elastomer layer 44 can undergo chunking where the elastomer material across the exposed surface of stator elastomer layer 44 has been worn away. Debonding of stator elastomer layer 44 is the failure of the bonding agent that secures stator elastomer layer 44 to stator tube 40.

Another reason for failure of stator elastomer layer 44 is a poor fit between rotor 28 and stator assembly 26. A poor fit between rotor 28 and stator assembly 26 may result from improper tolerances due to degradation of stator elastomer layer 44 with time. In addition, if the initial fit between rotor 28 and stator assembly 26 is incorrect, then the differential pressure across drilling motor system 20 may be either too high or too low. If the differential pressure is too high the high differential pressure can damage drilling motor system 20. If the differential pressure is too low, drilling motor system 20 will be weak and could stall which may lead chunking of stator elastomer layer 44.

A further reason for failure of stator elastomer layer 44 is down-hole and mud temperatures that can cause thermal fatigue of stator elastomer layer 44. Certain drilling fluids may also cause stator elastomer layer 44 to swell. Swelling of stator elastomer layer 44 can be compensated for during the design and manufacture of drilling motor system 20, but can still result in failure of stator elastomer layer 44.

In order to detect a failure of stator elastomer layer 44, stator elastomer layer 44 includes a failure detection system. The failure detection system is included in stator elastomer layer 44 and can identify a region of damaged stator elastomer layer 44.

Looking at FIGS. 2-3, the failure detection system can include dyed elastomer material 52 that forms stator elastomer layer 44. Dyed elastomer material 52 can identify a region of damaged stator elastomer layer 44. As an example, if an operator was to find a chunk of dyed elastomer material 52 within the shaker, the operator could identify that such chunk was from stator elastomer layer 44.

In order to further pinpoint the location of the failure of stator elastomer layer 44, dyed elastomer material 52 includes two or more color codes, each color code being located along a separate portion of the axial length of stator elastomer layer 44. Looking at FIG. 2, dyed elastomer material 52 includes three separate portions of the axial length of stator elastomer layer 44. First axial portion 54 can be a downhole portion of dyed elastomer material 52 and includes dyed elastomer material of a first color code, second axial portion 56 can be an middle portion of dyed elastomer material 52 and includes dyed elastomer material of a second color code, and third axial portion 58 can be an uphole portion of dyed elastomer material 52 and includes dyed elastomer material of a third color code. In this way, if an operator was to find a chunk of dyed elastomer material 52 within the shaker, the operator could identify that such chunk was from stator elastomer layer 44 and also identify which axial portion of stator elastomer layer 44 is experiencing a failure.

Stator elastomer layer 44 can have a variety of causes of failure. As an example, chunks or pieces of stator elastomer layer 44 can be broken off due to an elevated solid content or sand in the mud. In such a situation stator elastomer layer 44 would most likely be damaged at an uphole portion of stator elastomer layer 44. If an operator finds chunks of dyed elastomer material of third axial portion 58, the operator can suspect that damage to stator elastomer layer 44 is due to an elevated solid content or sand in the mud. Chunks or pieces of stator elastomer layer 44 can alternately be broken off due to an elevated differential pressure that is above the limits of the motor. In such a situation stator elastomer layer 44 would most likely be damaged at a middle portion of stator elastomer layer 44. If an operator finds chunks of dyed elastomer material of second axial portion 56, the operator can suspect that damage to stator elastomer layer 44 is due to an elevated differential pressure that is above the limits of the motor. Chunks or pieces of stator elastomer layer 44 can alternately be broken off due to motor stalls. In such a situation stator elastomer layer 44 would most likely be damaged at a downhole portion of stator elastomer layer 44. If an operator finds chunks of dyed elastomer material of first axial portion 54, the operator can suspect that damage to stator elastomer layer 44 is due to a motor stall.

Currently available drilling motors use a default black colored elastomer which it is the same color of rubber that is used in the Kelly hose and another flexible hoses connected to the rig system. Because both rubber and vulcanized rubber are greatly affected by conditions such as temperature range, presence of corrosive elements, and material stability, numerous considerations must be taken into account when coloring these materials. The presence of a toxic or destabilizing substance within a pigment or the improper application of coloring agents can severely damage a rubber product run and reduce cost-efficiency.

Aesthetic qualities, such as the uniformity and fastness of the alteration, are important considerations when coloring any material. In the case of rubber, drift resistance is one of the central criteria in choosing an appropriate pigment.

Many manufacturers use a migration test to determine if a given pigment will cause colors to run, fade, or bleed into other surfaces. This test employs a range of different pigment concentrations, each of which is applied to a standard white rubber sheet. The pigmented sheet is then quickly vulcanized under a hot steam exposure process, usually for no longer than half an hour. Engineers place cotton fabric against the colored rubber to ascertain if color has bled into the fabric or into the rubber.

Because rubber is influenced by temperature changes, the pigmentation of a rubber must result in a rubber product that is able to withstand required heat ranges or react to thermal treatments in a particular way. Heat resistance tests involve multiple pigment concentrations being tested simultaneously. These concentrations usually contain between 0.01 and 1 percent color composition and a 10-to-1 ratio of chalk. After the pigments are applied, the newly colored rubber sheets undergo a hot vulcanization process that can reach nearly 300 degrees Fahrenheit. The results are then compared to an uncolored white rubber sheet that goes through an identical heating procedure. If the pigmentation cracks, fades, bleeds, or in any way degrades the material quality of the rubber base, that concentration is deemed unsuitable for coloring purposes.

Industrial coloring methods are categorized by the International Organization of Standardization, which provides standards for manufacturing most kinds of pigments and dyes. This organization also delineates the chemical and physical properties of various pigments, as well as the techniques for testing coloring materials. Many coloring manufacturers also employ the Color Index International as the standard authority on naming specific colors and identifying their characteristics on the color spectrum. Rubber coloring pigments are typically applied in powdered or granulated form.

An example of a commonly used coloring agent in rubber fabrication is pyrazolone orange/yellow. This pigment is useful in a wide variety of rubber products due to its capacity for efficient vulcanization and low rate of bleeding in natural rubber. This pigment further has a high level of water resistance. Disazopyrazolone red is another commonly used coloring agent in rubber fabrication. When used in rubber materials, disazopyrazolone red displays excellent lightfastness, meaning it has a low rate of fading from exposure to light. In addition, disazopyrazolone red offers reduced potential for color drift or bleeding, and high water and solvent resistance. Phthalocyanine blue is yet another commonly used coloring agent in rubber fabrication. Although produced in limited volumes, phthalocyanine blue yields a high tolerance for heating treatments, and does not bleed into rubber or fabric. Phthalocyanine blue is also resistant to both hot and cold water, soaps, certain acids, and some corrosive solutions.

Looking at FIGS. 2-3, the failure detection system can alternately include a plurality of sensors 60. Sensors 60 can be spaced axially within stator elastomer layer 44. Sensors 60 can be a type of sensor that can be detected as either being in functioning state or a non-functioning state. A strain gauge is one such type of sensor that could be used as sensor 60.

Figure 4:
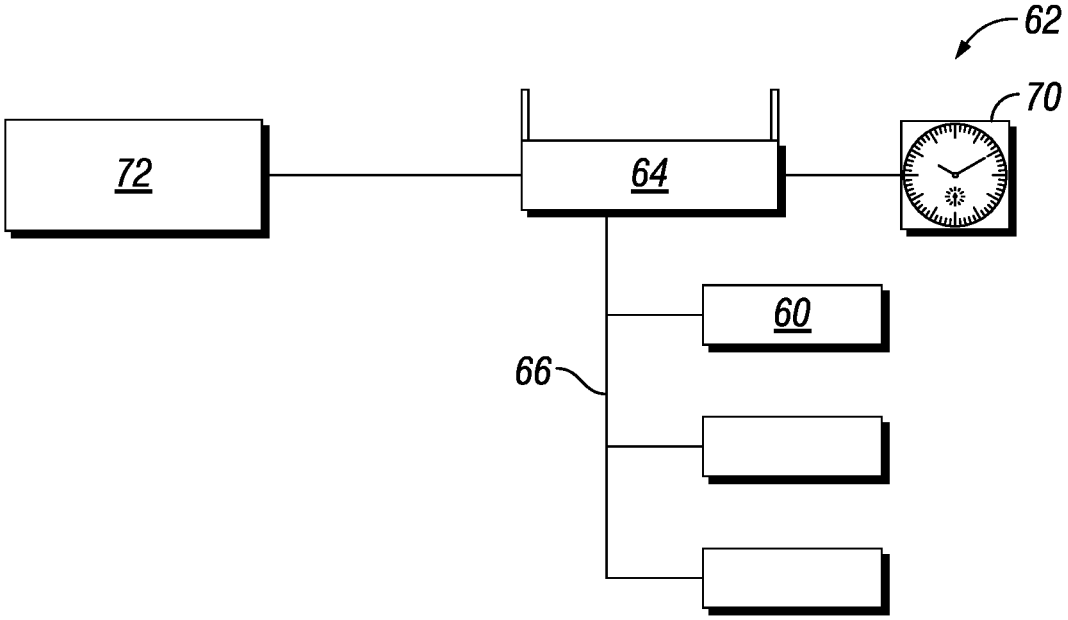
FIG. 4 is a schematic view of a communication system of a drilling motor system, in accordance with an embodiment of this disclosure.

Looking at FIGS. 3-4, communication system 62 includes central unit 64. Central unit 64 can detect and transmit a status of each of the sensors 60. Each of the sensors 60 can communicate with central unit 64 by way of wires 66. In alternate embodiments, each of the sensors 60 can communicate with central unit 64 wirelessly. Central unit 64 can receive information from sensors 60 and can transmit such information to a surface unit 68 wirelessly. As an example, a transmitter and receiver system can be used to wirelessly transmit the status of each sensor 60 from central unit 64 to surface unit 68. Alternately, where a central unit 64 can transmit the status of each sensor 60 to a measuring while drilling unit that is part of drill string 16, which in turn can transmit the status of each sensor 60 to surface unit 68.

The status of each sensor 60 can be transmitted as functioning or non-functioning. Information passing between each sensor 60 and central unit 64 can be one way so that central unit 64 receives a transmission from each sensor 60, but central unit 64 does not transmit any data or information to any sensor 60. If the status of a sensor 60 is non-functioning, then such sensor may be non-functioning due to a failure of stator elastomer layer 44 at the location of such non-functioning sensor 60. After a non-functioning sensor 60 has been identified by surface unit 68, operators can check the shakers for chunks of stator elastomer layer 44 to confirm the failure of stator elastomer layer 44.

Communication system 62 can activate and deactivate central unit 64, instructing central unit 64 when to deliver the status of each of the plurality of sensors 60. As an example, timer 70 can be used to both activate and deactivate central unit 64. Timer 70 can be programed at the surface to transmit the status of each of the plurality of sensors 60 at predetermined time intervals. In alternate embodiments, surface unit 68 can instruct central unit 64 when to deliver the status of each of the plurality of sensors 60.

Battery 72 of communication system 62 can provide sufficient power to central unit 64 to ensure the operation of communication system 62 for the duration of the operation of drilling motor system 20. In alternate embodiments, battery 72 can also provide power to one or more of the sensors 60.

Embodiments described in this disclosure therefore can improve the identification of stator elastomer failure in drilling motors. The use of sensors and dyed elastomer allows for an automated the process to identify failure of stator elastomer, and to pinpoint the location of the failure. This information can further be used to help identify the reason for the stator elastomer failure in real time while the drilling motor is operating. The early identification of failure of the stator elastomer provided by this disclosure can prevent damage to related equipment.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A drilling motor system for drilling a subterranean well, the system including:

a stator tube, the stator tube being an elongated tubular member with a central stator bore;

a stator elastomer layer, the stator elastomer layer located within the central stator bore and lining a wall of the central stator bore, the stator elastomer layer having an elastomer bore that includes a plurality of stator lobes extending in a helical pattern along an axial length of the central bore;

a rotor located within the elastomer bore, the rotor being an elongated member that includes a plurality of rotor lobes extending in a helical pattern along an axial length of the rotor; and where the stator elastomer layer is a dyed elastomer material, where the dyed elastomer material is formed of two or more color codes, each color code being located along a separate portion of the axial length of the stator elastomer layer forming a failure detection system operable to identify a region of damaged stator elastomer layer.

2. The system of claim 1, where the failure detection system further includes a plurality of sensors, the plurality of sensors spaced axially within the stator elastomer layer.

3. The system of claim 2, where the failure detection system includes a communication system with a central unit that is operable to transmit a status of each of the plurality of sensors.

4. The system of claim 3, where the communication system is operable to activate the central unit to deliver the status of each of the plurality of sensors.

5. The system of claim 3, where the communication system includes a timer operable to activate and deactivate the central unit.

6. A drilling motor system for drilling a subterranean well, the system including:

a stator tube, the stator tube being an elongated tubular member with a central stator bore;

a top sub secured to an uphole end of the stator tube, the top sub connected to a drilling string;

a stator elastomer layer, the stator elastomer layer located within the central stator bore and lining a wall of the central stator bore, the stator elastomer layer having an elastomer bore that includes a plurality of stator lobes extending in a helical pattern along an axial length of the central stator bore, and where the stator elastomer layer is a dyed elastomer material, where the dyed elastomer material is formed of two or more color codes, each color code being located along a separate portion of the axial length of the stator elastomer layer forming a failure detection system operable to identify a region of damaged stator elastomer layer;

a rotor located within the elastomer bore, the rotor being an elongated member that includes a plurality of rotor lobes extending in a helical pattern along an axial length of the rotor;

a transmission assembly, the transmission assembly rotationally secured between the rotor and a drill bit drive shaft; and a bottom sub secured downhole of the stator tube, the bottom sub housing the drill bit drive shaft and a bearing assembly.

7. The system of claim 6, where the failure detection system further includes a plurality of sensors, the plurality of sensors spaced axially within the stator elastomer layer.

8. A method for drilling a subterranean well with a drilling motor system, the method including:

providing the drilling motor system having:

a stator tube, the stator tube being an elongated tubular member with a central stator bore;

a stator elastomer layer, the stator elastomer layer located within the central stator bore and lining a wall of the central stator bore, the stator elastomer layer having an elastomer bore that includes a plurality of stator lobes extending in a helical pattern along an axial length of the central stator bore, where the stator elastomer layer is a dyed elastomer material, and where the dyed elastomer material is formed of two or more color codes, each color code being located along a separate portion of the axial length of the stator elastomer layer, forming a failure detection system; and a rotor located within the elastomer bore, the rotor being an elongated member that includes a plurality of rotor lobes extending in a helical pattern along an axial length of the rotor; and identifying a region of damaged stator elastomer layer with the failure detection system; where identifying the region of damaged stator elastomer layer with the failure detection system includes identifying the region of damaged stator elastomer layer with the dyed elastomer material that forms the stator elastomer layer.

9. The method of claim 8, where identifying the region of damaged stator elastomer layer with the failure detection system further includes identifying the region of damaged stator elastomer layer with a plurality of sensors, the plurality of sensors spaced axially within the stator elastomer layer.

10. The method of claim 9, further including transmitting a status of each of the plurality of sensors with a communication system with a central unit.

11. The method of claim 10, further including activating the central unit with the communication system to deliver the status of each of the plurality of sensors.

12. The method of claim 10, further including activating and deactivating the central unit with a timer of the communication system.

* * * * *